US005558467A

United States Patent [19]

Horton

[11] Patent Number: 5,558,467

[45] Date of Patent: Sep. 24, 1996

[54] DEEP WATER OFFSHORE APPARATUS

[75] Inventor: Edward E. Horton, Rancho Palos Verdes, Calif.

[73] Assignee: Deep Oil Technology, Inc., Irvine, Calif.

[21] Appl. No.: 336,377

[22] Filed: Nov. 8, 1994

[51] Int. Cl.[6] ..... E02B 17/00

[52] U.S. Cl. ..... 405/195.1; 405/224; 166/345; 166/355

[58] Field of Search ..... 405/205, 207, 405/210, 224, 195.1; 175/7, 8, 9; 166/338, 339, 341, 344, 345, 350, 354, 355, 359

[56] References Cited

U.S. PATENT DOCUMENTS

| | | | |
|---|---|---|---|
| 2,953,904 | 9/1960 | Christenson . | |
| 3,001,370 | 9/1961 | Templeton . | |
| 3,118,283 | 1/1964 | True et al. . | |
| 3,277,653 | 10/1966 | Foster . | |
| 3,385,069 | 5/1968 | Estes . | |
| 3,404,413 | 10/1968 | Clark . | |
| 3,470,838 | 10/1969 | Daniell . | |
| 3,510,892 | 5/1970 | Monnereau et al. . | |
| 3,572,278 | 3/1971 | Knapp et al. . | |
| 3,895,495 | 7/1975 | Akazaki et al. . | |
| 3,996,754 | 12/1976 | Lowery . | |
| 4,070,868 | 1/1978 | Sedlmayer et al. . | |
| 4,413,344 | 11/1983 | Abbott et al. | 405/227 X |
| 4,417,831 | 11/1983 | Abbott et al. | 405/227 |
| 4,516,882 | 5/1985 | Brewer et al. . | |
| 4,702,321 | 10/1987 | Horton . | |
| 4,710,061 | 12/1987 | Blair et al. | 405/224 X |
| 4,941,776 | 7/1990 | Bosgiraud et al. | 405/224 |

FOREIGN PATENT DOCUMENTS

| | | |
|---|---|---|
| 1212867 | 7/1994 | France . |
| 1484432 | 2/1969 | Germany . |
| 1456235 | 10/1969 | Germany . |
| 991247 | 5/1965 | United Kingdom . |
| 2003964 | 3/1979 | United Kingdom . |

*Primary Examiner*—William P. Neuder
*Attorney, Agent, or Firm*—Poms, Smith, Lande & Rose Professional Corporation

[57] ABSTRACT

A deep water offshore apparatus for use in oil drilling and production in which an upper buoyant hull of prismatic shape is provided with a passage longitudinally extending through the hull in which risers run down to the sea floor, the bottom of the hull being located at a selected depth dependent upon the wind, wave, and current environment at the well site, which significantly reduces the wave forces acting on the bottom of the hull, a frame structure connected to the hull bottom and extending downwardly and comprising a plurality of vertically arranged bays defined by vertically spaced horizontal water entrapment plates and providing open windows around the periphery of the frame structure, the windows providing transparency to ocean currents and to wave motion in a horizontal direction to reduce drag, the vertical space between the plates corresponding to the width of the bay window, the frame structure being below significant wave action whereby wave action thereat does not contribute to heave motion of the apparatus but inhibits heave motion, the frame structure serving to modify the natural period and stability of the apparatus to minimize heave, pitch, and roll motions of the apparatus. A keel assembly at the bottom of the frame structure with ballast chambers for enabling the apparatus to float horizontally and for stabilization of the apparatus against tilting in vertical position, and taut anchor lines connected to the apparatus at a location of relatively little cyclic movement of the apparatus, the said lines being connected to suitable anchors.

30 Claims, 9 Drawing Sheets

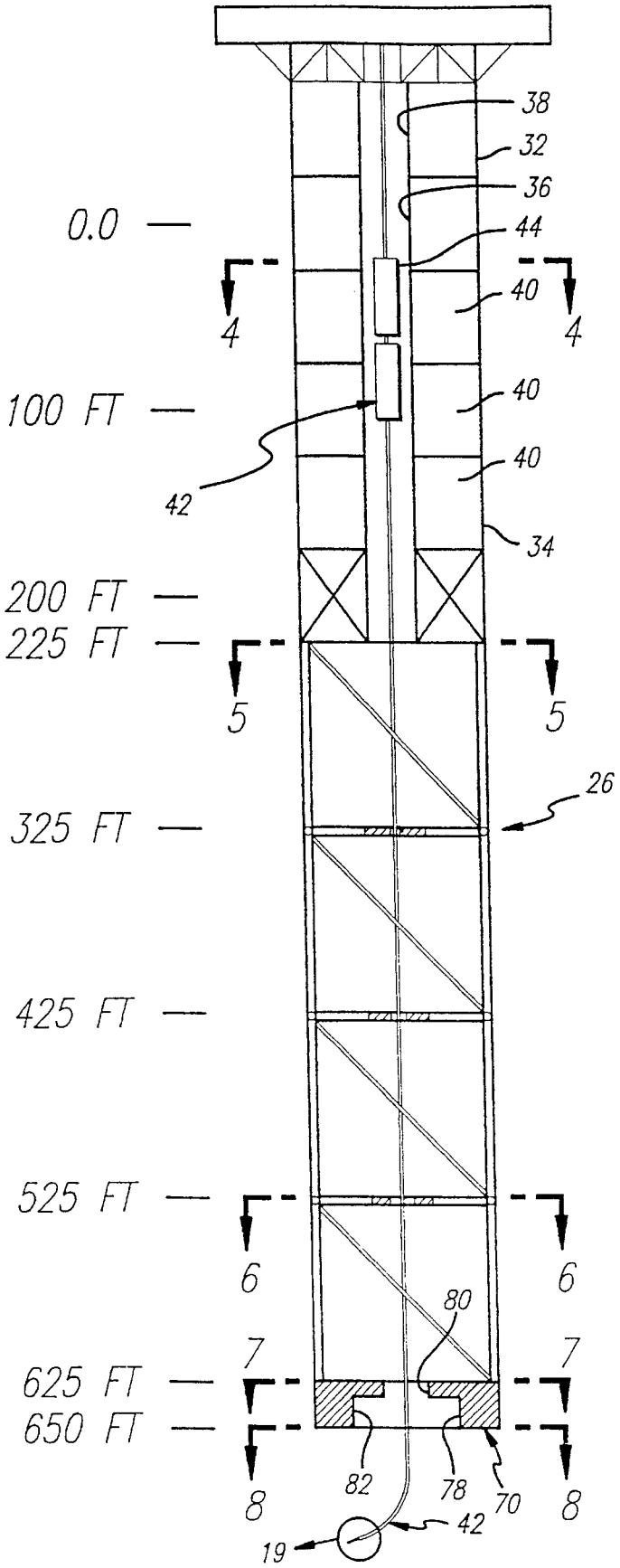
FIG. 3
FIG. 19
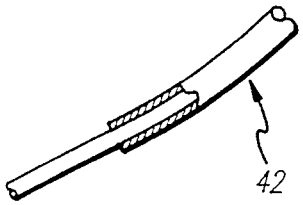

DEEP WATER OFFSHORE APPARATUS

BACKGROUND OF INVENTION

This invention relates to a floating deep water offshore apparatus or jacket spar for use in drilling and production of offshore wells for extended periods of time.

Prior proposed apparatus of spar type have included a long vertically disposed floating hull, body, or caisson with an upper structure above the water and a lower structure immersed in the water a selected depth. The upper structure is subjected to winds and currents and the lower structure is subjected to variable wave motion. Means to stabilize the apparatus against heave motion, pitching and roll motions have been proposed and have included the use of horizontally disposed areas vertically spaced along the longitudinal axis of the spar to modify the heave response of the apparatus. Such spacing was very great as shown in U.S. Pat. Nos. 3,404,413; 3,510,892. The use of relatively wide large horizontal surface areas to act as virtual mass trap means is described in U.S. Pat. No. 4,516,882 where the use of such areas is in connection with conversion between tension leg platform and semisubmersible modes. Such prior apparatus also included an anchor system in which mooring lines were connected with the lower portion of the hull structure and connected to anchor means in the sea floor in a gravity catenary mode or in a taut mode with the lines under tension. In some instances the bottom of the floating structure included ballast means.

SUMMARY OF INVENTION

The present invention contemplates a novel offshore spar type apparatus which may be readily moored over one or more sea floor wellheads for extended periods of time required to drill and produce the field. Under all environmental conditions the motions of the apparatus are such that drilling and production operations may be carried out, personnel and equipment can perform effectively, and particularly the vertical stiff risers for conducting well fluid will remain connected to the wellheads. In order to achieve the above general objectives, the spar type apparatus embodies a novel design in which an upper buoyant floating hull body of caisson shape is connected at its bottom end to a novel construction of a frame means of of an open horizontally transparent truss structure, the frame means having a length which may be greater than the length of the hull body dependent upon the wave, wind,and current conditions anticipated at the particular well site. Further, the truss frame is designed with a plurality of vertically spaced bays defined by vertically spaced horizontal plates and providing transparent windows on each side of the truss frame. The windows lend transparency to the frame structure, and permit virtually unobstructed motion of ocean currents transversely through the bays. At the same time the spaced horizontal imperforate plates [except for the riser passageway] entrap water therebetween, the plates being spaced in relation to the horizontal width of the bays so that an effective added water mass approximately equal to the volume of a cube with the same dimensions of the plate is achieved. As a result of this construction, the apparatus of this invention may be designed to minimize heave, pitch and roll motions of the apparatus and further to achieve a desirable natural period of the apparatus for any given wave conditions expected at the well site.

The primary object of this invention therefore is to provide a novel offshore apparatus of spar type for oil drilling and production operations.

An object of this invention is to provide a novel arrangement of hull means and truss frame means interconnected at a selected depth and responding to environmental conditions at a well site in a stable manner and with minimum heave, pitch, and roll effects.

Another object of this invention is to provide a truss frame means adapted to extend below a floating hull means in which the frame means is virtually transparent to horizontal movement of the water and in which vertical movement of the water relative to the frame means is effectively trapped and contributes "added mass" to the hull-frame means in the vertical direction.

Another object of the invention is to provide the truss frame means with a keel assembly having ballast means to offset the weight of the deck and deck equipment and to lower the center of gravity of the apparatus below its center of buoyancy and thereby increase the stability of the apparatus.

Another object of the invention is to provide buoyancy chambers in the keel assembly to facilitate positioning the apparatus in horizontal position for towing.

Specific objects of the invention may include a novel means for connecting the mooring lines through hawse pipes to the apparatus, and for connecting the mooring lines to anchor means embedded in the sea floor, a novel anchor box construction for a taut mooring line, and a novel means for increasing the area of an entrappment plate.

Other objects and advantages of the present invention will be readily apparent from the following description of the drawings in which an exemplary embodiment of the invention is shown.

IN THE DRAWINGS

FIG. 3 is a side view of the hull means and frame means, partly in section, showing exemplary depths of water in relation to the apparatus, and a schematic rise system.

Figure 17:
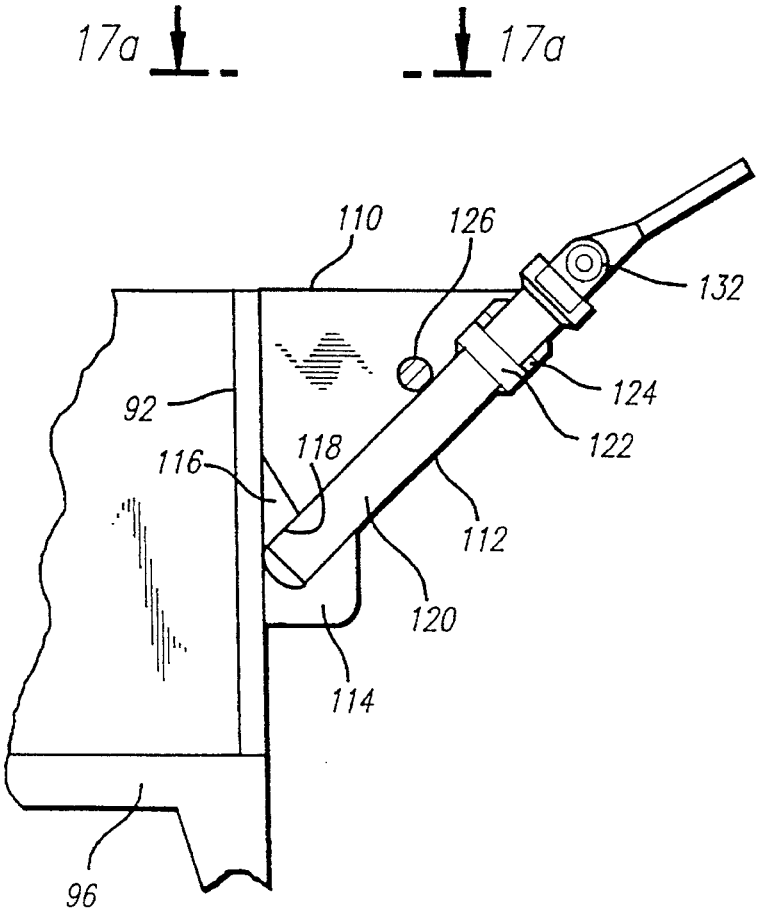
FIG. 17 is an enlarged fragmentary view of the anchor pin and line connection shown in FIG. 16.
Figure 17A:
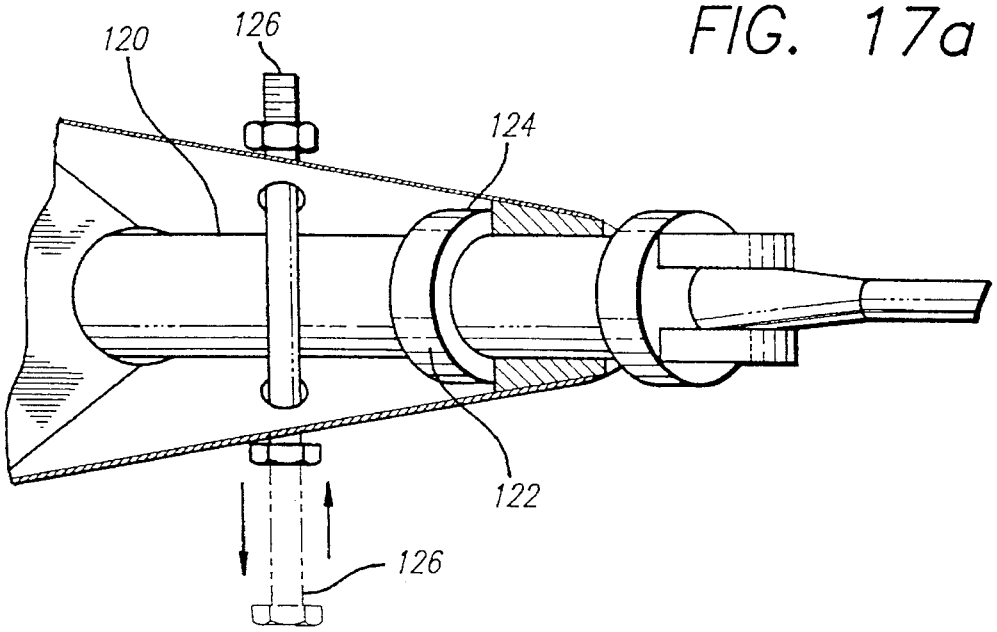

FIG. 17*a* is a fragmentary top view of FIG. 17 taken from the plane indicated by line 17*a*—17*a* of FIG. 17.

Figure 18:
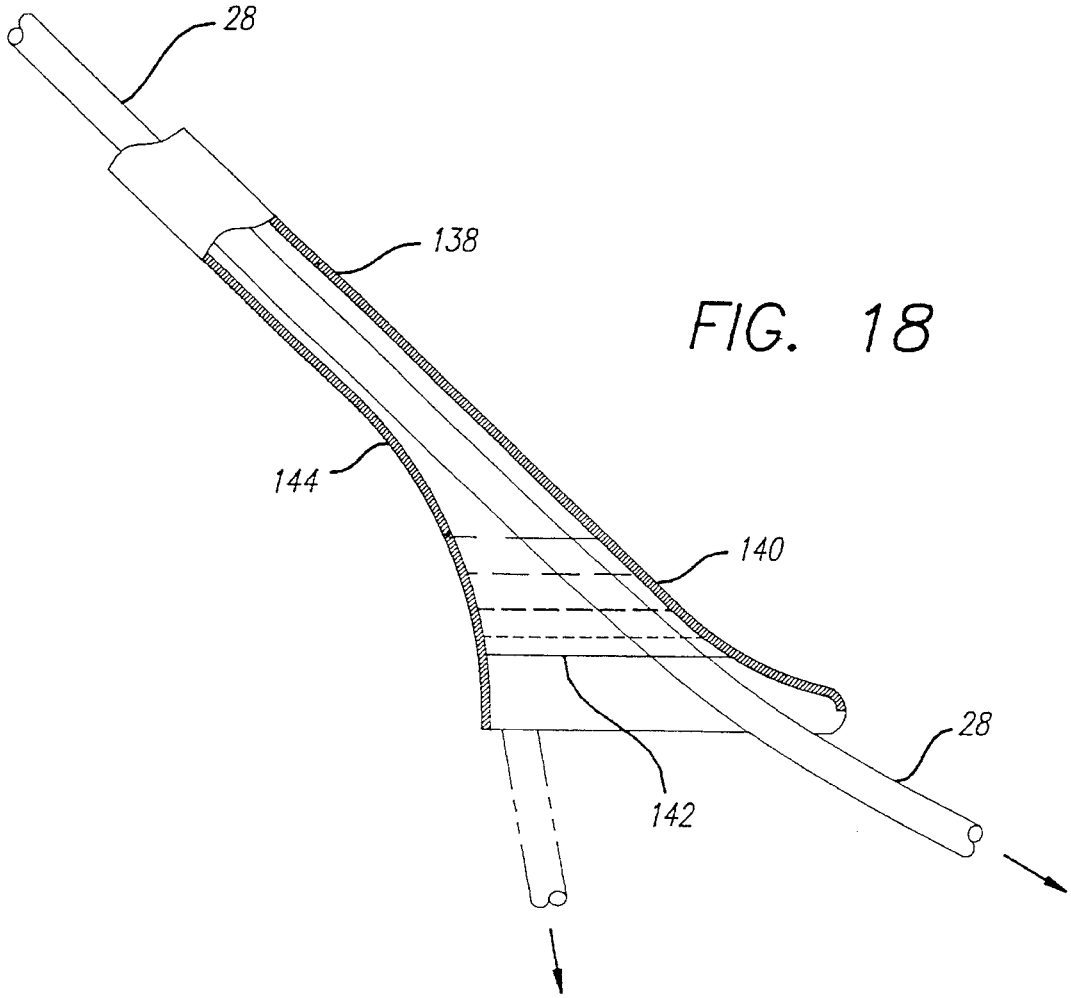

FIG. 18 is an enlarged fragmentary view, partly in section, of a fair lead connection to the frame means of the apparatus.

FIG. 19 is an enlarged fragmentary view of a riser pipe and stinger at the circle indicated at 19 in FIG. 3.

DETAILED DESCRIPTION

Figure 1:
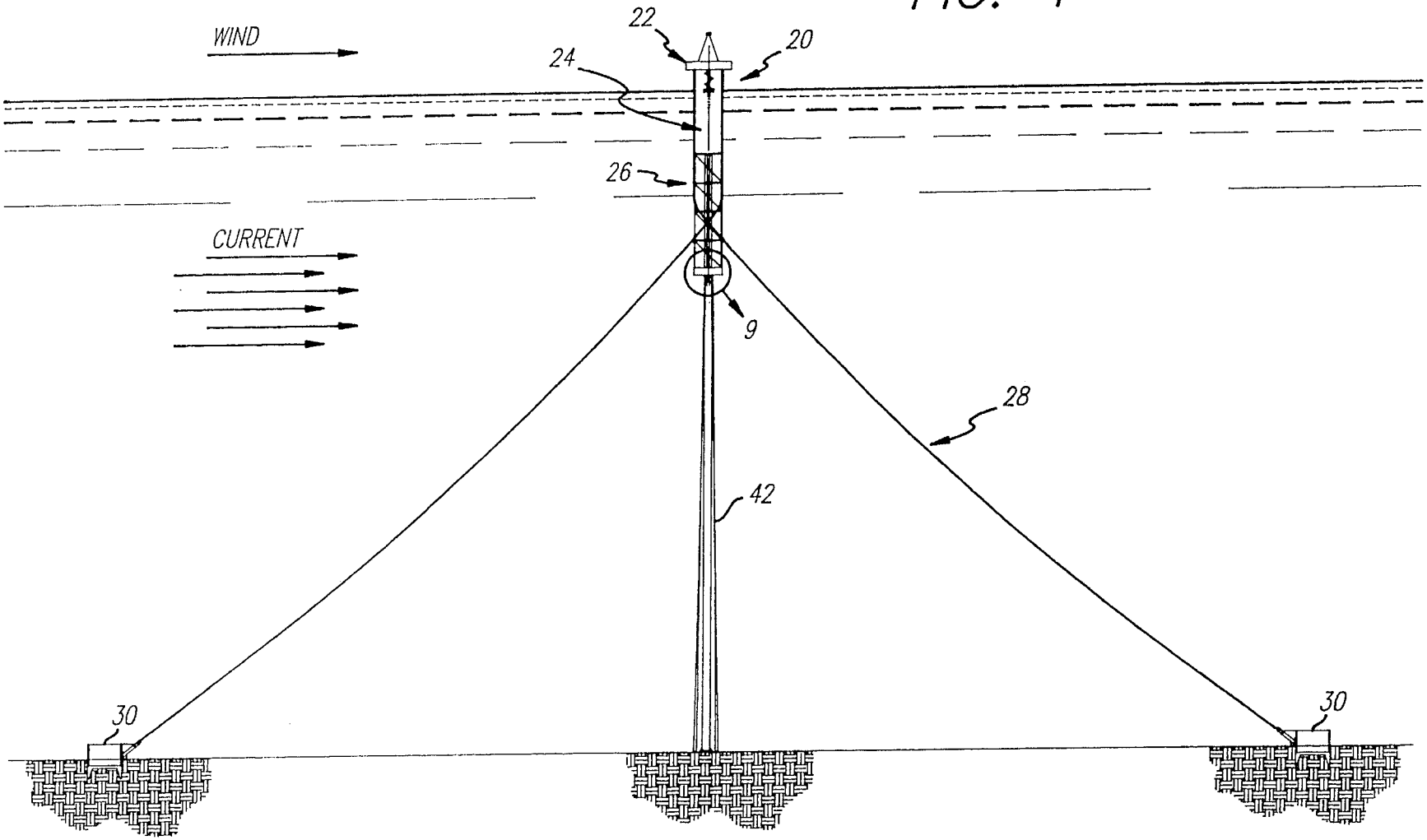
FIG. 1 is an elevational view of an offshore apparatus embodying this invention, installed in deep water, and anchored with taut mooring lines.

In FIG. 1 a deep water offshore apparatus embodying this invention is generally indicated at 20 and generally comprises a top deck 22 supported by a buoyant hull means 24 partially submerged in the water, and a frame means 26 connected to the bottom end of the hull means and extending downwardly into a depth of water below significant wave action. Anchor lines generally indicated at 28 are connected to the frame means at a selected depth and are connected to anchor means 30 embedded in the sea floor, the anchor lines providing a taut anchor system as later described.

HULL MEANS

Hull means 24, in this example, may be of cylindrical shape with straight sides along its upper and lower portions 32 and 34. The shape of the hull means may also be prismatic. The length of the hull means may extend below the water surface about 225 feet (FIG. 3) depending upon the wave environment and may extend above the surface of the water a selected height to support the upper deck and to provide space for drilling and production equipment, housing facilities, and other necessary items for operation of the apparatus.

The hull means includes a concentric internal wall 36 defining a central passageway or well 38 for the length of the hull. Between the wall 36 and the outer wall of the hull are provided a number of compartments 40 which may be utilized for variable water ballast, oil storage,and work spaces.

A riser system 42, generally indicated in the central well, may include a plurality of riser pipes supported by buoyancy cans 44 in the manner described and shown in my U.S. Pat. No. 4,702,321 issued Oct. 27, 1987. The central well 38 is open at the bottom, sea water fills the well, and supports the buoyancy cans 44 with minimal relative movement between the cans and the hull means.

FRAME MEANS.

Frame means 26 is connected to the bottom end portion of the hull means and extends downwardly therefrom a selected distance. The depth of the interface connection between the hull means and the upper end of the frame means is dependent on the wave action at the well site and is selected at a depth at which the wave energy has been attenuated. For example, in areas of relatively calm short period waves the interface connection may be in the order of 100 feet depth. In rough high long period waves the interface connection may be closer to 250 feet. The longitudinal lengths of the hull means and the frame means are related to the particular wave environment and conditions at the particular well site in order to achieve an apparatus in which heave, pitch and roll motions of the apparatus are reduced to a minimum.

The frame means is constructed to provide a plurality of vertically arranged bays 50 defined by vertically spaced horizontal plates 52. The frame means includes longitudinal vertical columns 54 interconnecting said plates 52 at corners thereof, and diagonal truss members 55, the plates in this example being square. Plates 52 may be polygonal or circular, and imperforate except for openings to accommodate the riser pipes. The arrangement of plates and connecting columns is such as to provide large windows 56 on all sides of the frame through which water moving in a horizontal direction may readily pass.

Figure 2:
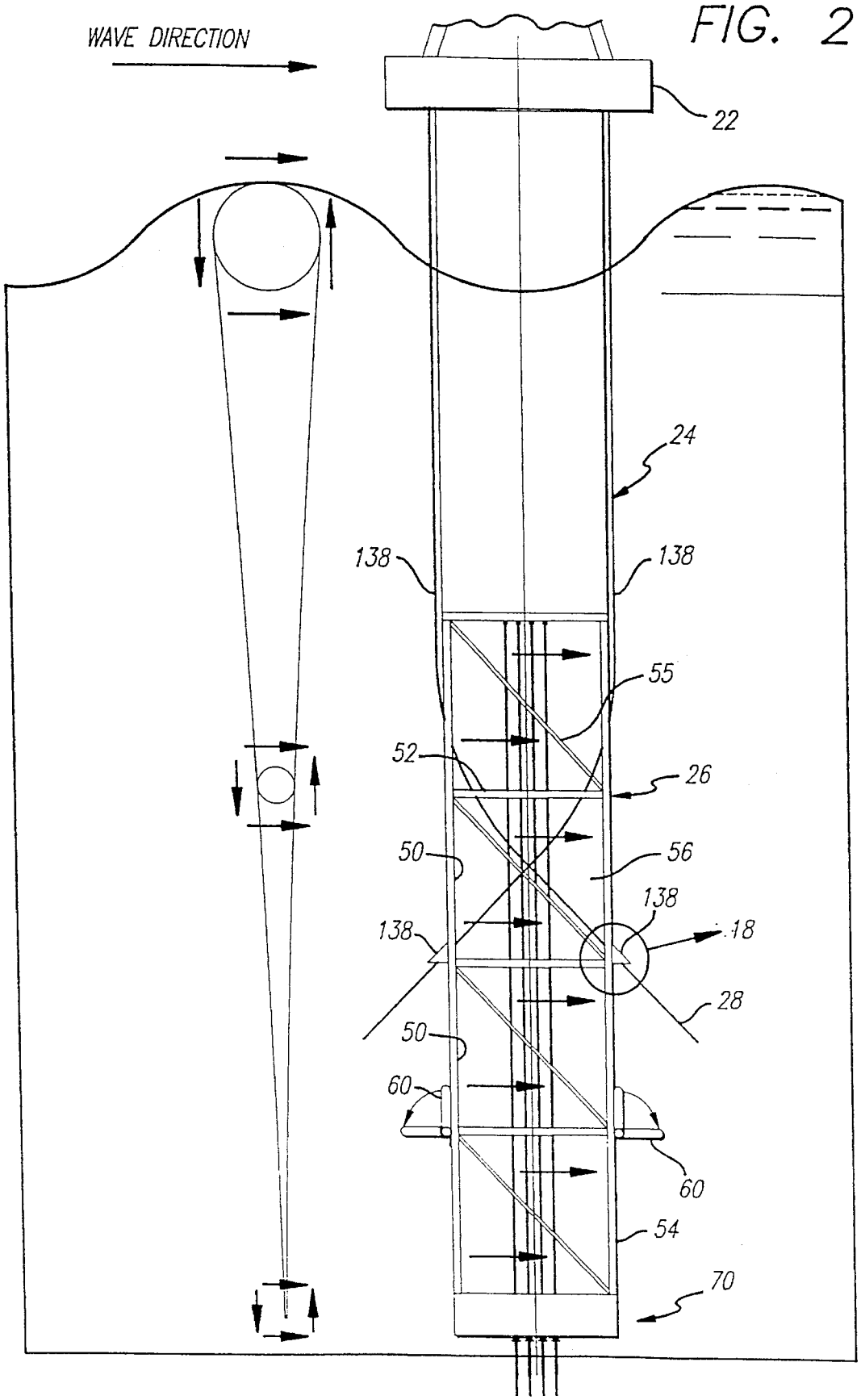
FIG. 2 is partial elevational view of the apparatus shown in FIG. 1 alongside a schematic illustration of a wave loop current.

Plates 52, with their substantially imperforate structure and selected spacing related to the dimensions of the plates, serve to entrap water between them when the relative movement of the apparatus and the water particles outside the frame means is vertical. The entrapped water is below the significant wave action, as diagrammatically indicated by the path of water particles to the left of the apparatus as shown in FIG. 2. Thus the waves do not contribute to the heave motion of the apparatus, but instead inhibit its heave motion. It should be further noted that the mass of the entrapped water in the bays 50 acts as a part of the apparatus in the vertical direction. Such action or effect serves to increase the natural period of the apparatus and in the configuration shown is substantially longer than the wave energy periods. As an example, waves in the Gulf of Mexico as in a 100 year design storm may have a peak period of 14 to 16 seconds. The exemplary configuration of the present apparatus has a heave period of about 28 seconds, much longer than the said peak period of the waves.

It may be noted that deep draft floating platforms of elongate structure having bottom portions extending to a depth of 650 feet, or where wave action is insignificant, may be subjected to high currents which result in high loads on the structure and which may result in unwanted vibrations due to periodic vortex shedding, sometimes referred to as vortex induced vibration (VIV). In the design of the present apparatus the energy of any vortex induced vibrations developed by the upper hull are absorbed by the frame means by the transparency of the bays to horizontal motion of the water and by the entrappment of the water between the vertically spaced entrapment plates. The masses of water entrapped by the horizontal plates, when moving in the vertical direction, causes fluid in their vicinity to accelerate and thus contribute "added mass" to the apparatus in the vertical direction. The amount of such added mass for each bay is approximately one-half the volume of a cube [or a sphere] having three dimensions based on the two dimensions of an entrapment plate 52 and the vertical height of the bay. Thus under the present invention a desirable natural period for any given wave condition can be provided for the apparatus by selecting the number of plates, their dimensions, and their vertical spacing in the construction of the frame means.

It will be understood that vertical motion of the apparatus is driven by pressure forces acting on the underside of the buoyant hull means 24. The pressure head is proportional to the wave elevation and decays exponentially with depth. The rate of decay depends on the period or wave length. Thus a buoyancy hull means having a draft of 200 to 300 feet receives more excitation forces than a 600 foot spar.

Figure 9:
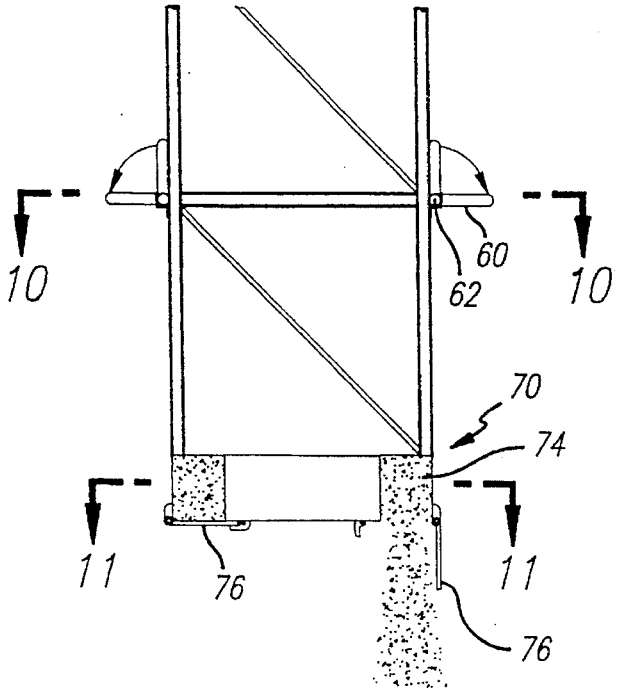
FIG. 9 is a more detailed view of the bottom portion of the frame means indicated by the circle in FIG. 1.
Figure 10:
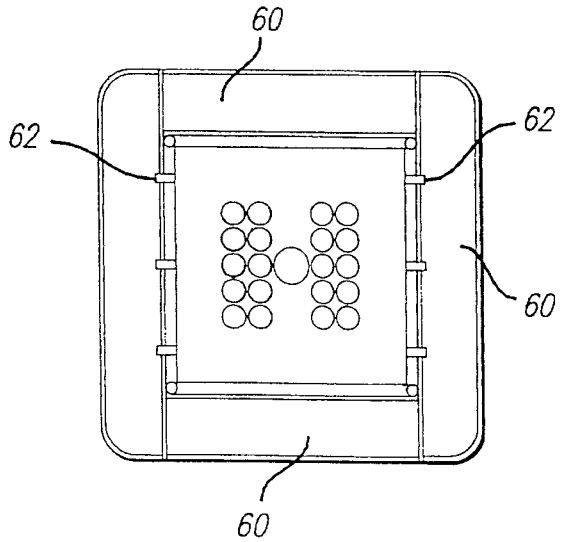
FIG. 10 is a horizontal plan view taken from the plane indicated by line 10—10 of FIG. 9.

In addition to the means for obtaining a selected natural period as described above, the mass entrapment plates may include plate extensions 60 as shown in FIGS. 2, 9, and 10. In this example each extension plate 60 may be pivotally connected as at 62 to the frame structure at the outer edge of a plate 52. The purpose of pivoting[ or retracting] extension plates 60 is to simplify launching of the apparatus and to reduce drag loads during transit. Such extension plates 60 may be provided on one or more plates 52 and will substantially increase the "added mass" of the entrapped water. More favorable surge and pitch dynamics can thus be achieved as well as heave characteristics.

While extension plates 60 are shown as having a pivotal connection to the frame means, other connections may be utilized such as horizontally sliding extension plates carried by a plate 52. Plates 60 may be fixed if launching or towing of the apparatus is not a factor to be considered.

FIGS. 4–8 show a schematic arrangement of the riser pipe system as the pipes pass through the several plates 52 and in the central well 38 of the hull means. In the transverse view shown in FIG. 4 the well 38 is indicated as of square cross section and the riser buoyancy cans 44 arranged in four rows of five risers each.

Figure 4:
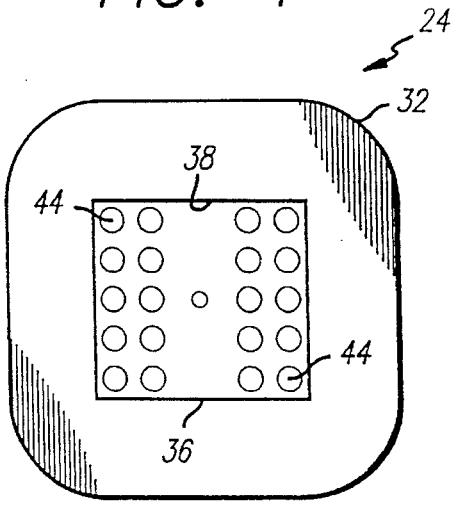
FIG. 4 is a transverse sectional view taken in the plane indicated by line 4—4 of FIG. 3.
Figure 5:
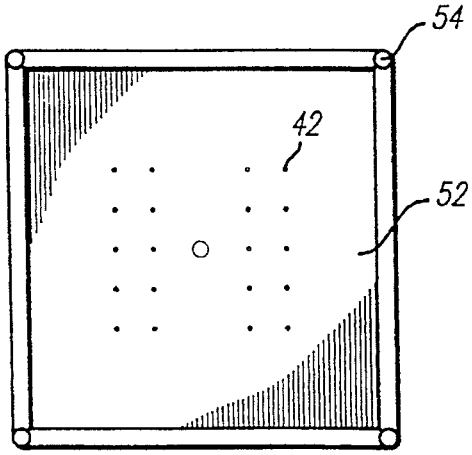
FIG. 5 is a transverse sectional view taken in the plane indicated by line 5—5 of FIG. 3.

In FIG. 5 the riser pipes 42 extend through the interface connection between the hull and frame means in the same arrangement shown in FIG. 4. and pass through plate 52 in openings slightly greater than the diameter of the pipes.

Figure 6:
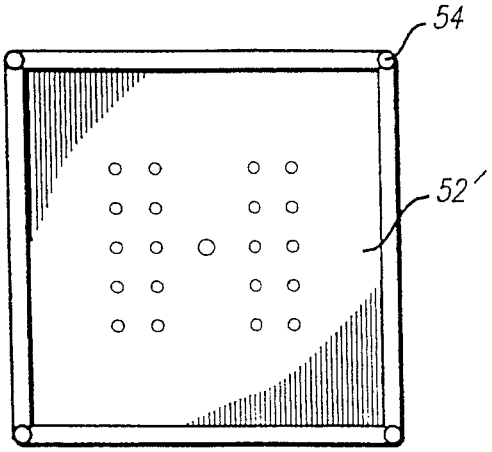
FIG. 6 is a transverse sectional view taken in the plane indicated by line 6—6 of FIG. 3.
Figure 7:
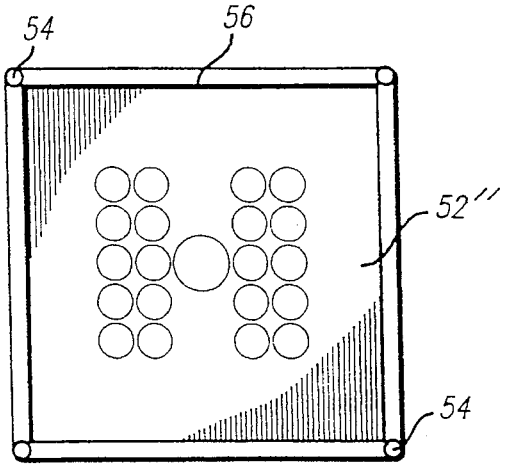
FIG. 7 is a transverse sectional view taken in the plane indicated by line 7—7 of FIG. 3.

As shown in FIGS. 6 and 7 the diameter of the pipe openings in plates 52' and 52" are progressively increased to accommodate some bending of the pipes during horizontal excursions of the apparatus.

Figure 8:
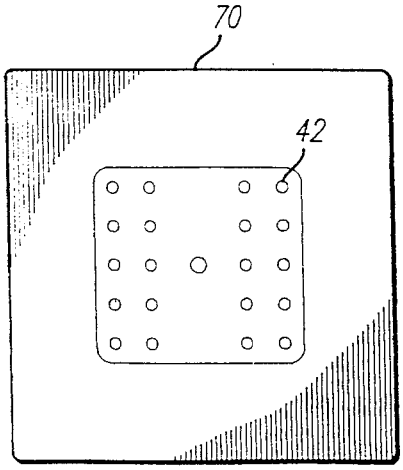
FIG. 8 is a transverse sectional view taken in the plane indicated by line 8—8 of FIG. 3.

FIG. 8 shows the pattern of the riser pipes 42 as they emerge from the keel assembly 70 which is described herebelow.

KEEL ASSEMBLY

Figure 11:
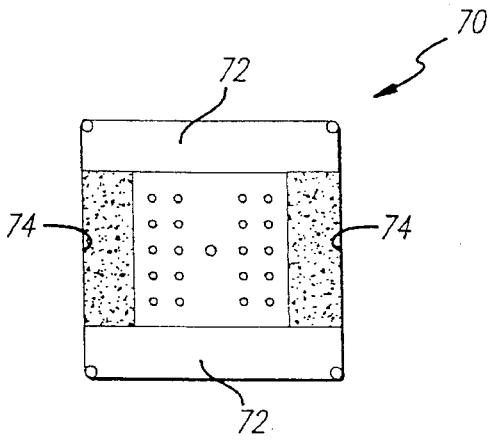
FIG. 11 is a sectional view taken in the plane indicated by line 11—11 of FIG. 9.

Keel assembly 70 is shown in FIGS. 9 and 11 and significantly affects the pitch and roll behavior of the apparatus. Assembly 70 includes buoyancy chambers 72 and ballast compartments 74. Chambers 72 provide buoyancy for the end of the frame means during towing when the frame means is horizontal and means, not shown, are provided for flooding the chambers when the frame means is upended.

Ballast compartments 74 may be filled with suitable ballast material such as sand and water, and may be installed either prior to upending the apparatus or after upending by using tremie pipe or permanent pipe in well known manner. The fixed ballast provides static stability when the apparatus is in place, offsets the weight of the top deck and equipment carried by the hull means, facilitates locating the center of gravity of the apparatus, and keeps the apparatus from excessive heeling in high winds and currents.

Each of the ballast compartments 74 may be provided with a downwardly opening hinged gate 76 for dumping the ballast in the event the apparatus is to be rotated to a horizontal position for towing to a new well site.

The keel assembly may also include buoyancy chambers such as 72 in which there is sufficient displacement to support the weight of the ballast. Compressed air may be injected into the chambers 72 to return the apparatus to a horizontal position. This arrangement permits the buoyancy chambers to be maintained at ambient pressure. Since full hydostatic pressure need not be maintained under this design a considerable saving in steel costs is realized.

The keel assembly as shown in FIGS. 3 and 19 includes a downwardly opening chamber having a relatively wide entry opening 80 through which the riser pipes pass with very loose clearance or tolerance. The bottom opening 82 is sufficiently wide so that when the riser pipes are subjected to some bending due to lateral movement of the apparatus, the pipes will avoid contact with the edges of the opening 82.

ANCHOR MEANS.

Figure 12:
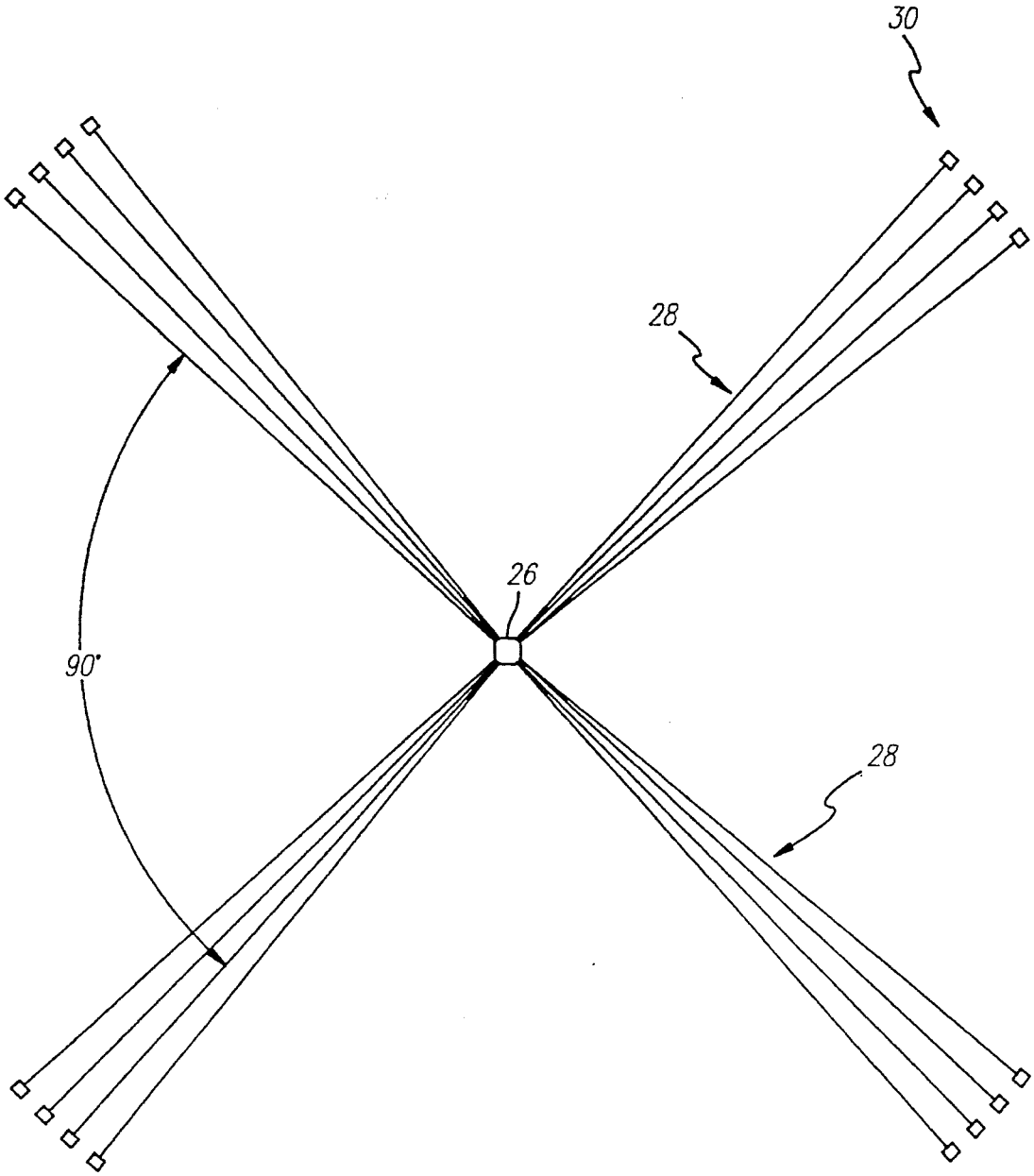
FIG. 12 is a schematic view of the arrangement of taut anchor lines.
Figure 13:
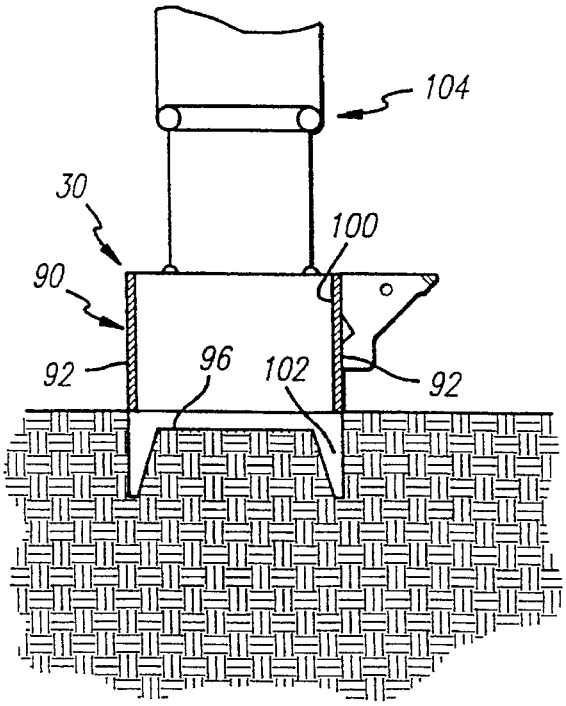
FIG. 13 is a fragmentary sectional view of installation of an anchor means for use with the apparatus shown in FIG. 1.
Figure 14:
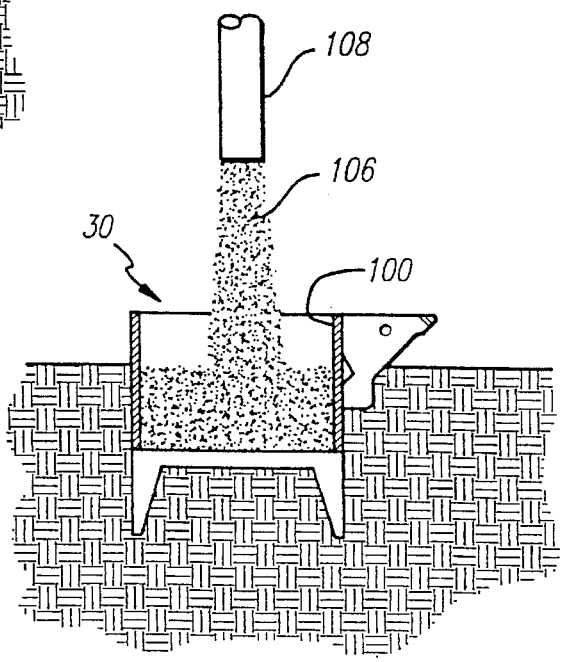
FIG. 14 shows filling of the anchor means with ballast.

Anchor means 30 is of gravity type and suitable for a 16 point mooring where each anchor holds the ends of four anchor lines, each group of four lines being arranged at 90 degrees as shown in FIG. 12 and further later described. Each anchor means 30 may comprise a hollow box 90 having vertical side walls 92 internally reinforced as at 94, joined by a bottom wall 96 having a plurality of drainage holes 98, and a top opening 100. The bottom wall 96 is provided with depending peripheral shear skirts 102. As shown in FIG. 13 suitable means 104 may be used to lower the box 90 to the sea floor, the skirts 102 initially penetrating the floor material. Ballast material 106 may be poured into the open box by means of a tremie pipe 108 until the box is full, the weight of the ballast material causing further settlement of the anchor box to an embedded position generally shown in FIG. 15.

Figure 16:
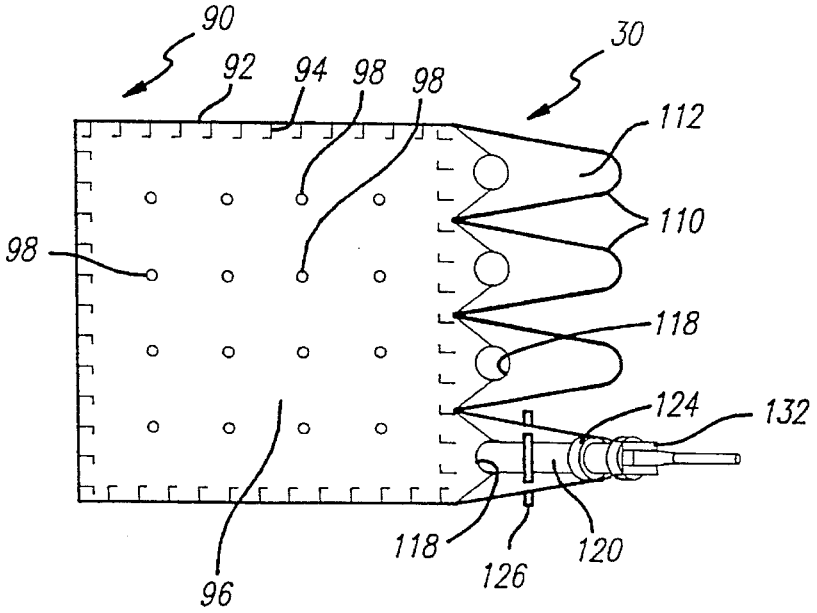
FIG. 16 is a plan view of the anchor means of FIG. 13 taken from the plane indicated by line 16—16 of FIG. 15, and showing only one anchor line connection.

The anchor box 90 is provided along one wall 92 with a plurality of sidewardly extending top opening receptacles 110 best shown in FIGS. 16, 17, and 17*a*. Each receptacle may be trough shaped with an upwardly inclined bottom wall 112 terminating at its lower end in a recess 114 and defining with a projecting abutment 116 an opening 118 to receive the lower end of an anchor pin 120. Spaced from the upper end of the pin 120 is an annular shoulder or lug 122 for abutment against a mating shoulder 124 on the receptacle when the anchor pin is in operable position to transmit mooring line forces the anchor box. An ROV [remote operating vehicle] actuated locking device 106 further secures the anchor pin against release from the receptacle 110. An anchor pin 126 is provided for each mooring line and receptacle 110.

Figure 15:
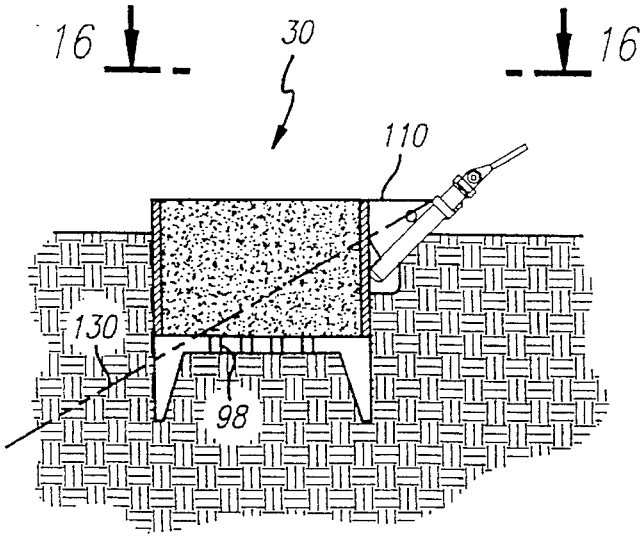
FIG. 15 shows installation of the anchor means of FIG. 13 completed.

It will be understood that the above described anchor design requires knowledge of the shear and bearing strength of the soil of the sea floor at the well site to determine the penetration depth of the anchor box, ballast requirements and holding capacity of the anchor. As indicated in FIG. 15 by the line 130 the direction of pull by the mooring line is such that the force vector passes through the trailing shear skirt of the anchor box at an area where resistance is greatest. The weight of the ballast keeps forcing this shear skirt downwardly into the sea floor formation to develop maximum resistance.

In installation of the anchor pin, the pin may be lowered in a vertical position with its lower end entering the receptacle outwardly of the abutment 116. The lower pin end may engage the bottom of the trough and then slide downwardly into the recess 114. It may then assume its upwardly inclined position with the mating shoulders in engagement to limit upward movement of the pin. The mooring line pivotal connection at 132 is spaced from the anchor box and readily accessible.

It is understood that other anchor systems may be used which may provide means for installing anchors independently from the mooring line, with the connector above the mud line for inspection by an ROV [remote operating vehicle], and the mooring line disconnected, brought to the surface and inspected and replaced without removing the anchor box.

MOORING LINES

The taut mooring line system is best shown in FIGS. 2, 12, and 18. FIG. 12 shows the schematic bundles of four mooring lines 28 extending from the frame means 26 in 90 degree relationship to the anchor means 30. A taut mooring system for the present purpose is one in which the mooring line does not lie on the sea floor adjacent to the anchor box and leaves the anchor at an upward angle as in FIG. 1. When the apparatus moves laterally from its neutral position the normally soft or slack lines become stiff and the mooring system may be considered as nonlinear. The taut system is advantageous for spar structures because there is relatively little cyclic motion at the fairlead connection of the lines to the frame means.

Further, if one of the four lines breaks the adjacent three lines of the group of lines will share the load equally and the holding capacity of the three lines is greater than a single line in a conventional equally spaced 16 mooring line arrangement.

As shown in FIG.2 each of the mooring line groups 28 may enter a hawse pipe 138 which may extend from its outboard connection to the frame means in a curvature of long radius to the opposite outboard side of the frame means and then proceeds upwardly along the outside of the hull means above the water and to the upper deck. The bell shaped lower end 140 of the hawse pipe may be radially outwardly flared to accommodate limited bending of the mooring lines as they exit the hawse pipe. By extending the hawse pipe above the water line, filling the hawse pipe with oil, and providing an oil-water interface 142 below the tangent point 144 of the mooring lines to the hawse pipe, the oil will serve to lubricate the mooring lines within the hawse pipe. The mooring lines are thus protected and maintenance reduced.

It will be readily understood by those skilled in the art that the novel construction and operation of the apparatus 20 provides distinct advantages over previous spar designs, such advantages including the following:

a. The hull means may be built in a shipyard and the frame means built in a steel fabrication yard, the two structures being then joined together either on land or on a barge.

b. The truss structure of the frame means requires less steel than a cylindrical caisson below the hull.

c. The effect of the truss structure of the frame means reduces the amplitude of vortex induced vibrations developed by the hull.

d. In horizontal position during towing or when floating the bending loads on the hull means are reduced.

e. The loads on the mooring lines are reduced because of the transparency of the truss to ocean currents and reduced vortex induced vibrations.

f. The progressively increasing diameter of the guide openings in the plates for the riser pipes control the curvature and stresses of the risers during pitch, rolling, surging, sways, and yaw motions of the apparatus. The hole diameters in the plates can be established to take into account the number of stress cycles and magnitude thereof to insure structural integrity and extended fatigue life for the anticipated environmental conditions.

It will be understood that various modifications and changes may be made in the above described apparatus and all such changes and modifications coming within the spirit of the present invention and the scope of the claims appended hereto are embraced thereby.

I claim:

1. In a deep water offshore apparatus for us in oil drilling and production, the combination of:

an upper hull means having an upper end portion adapted to provide buoyancy to the apparatus and to extend above the water surface and support an equipment deck and a lower end portion adapted to extend downward to a selected water depth;

means connected to the lower end of the hull means and extending downwardly therefrom for minimizing heave, pitch, and roll motion of the apparatus;

said downwardly extending means comprising:

frame means including columns and vertically spaced entrapment plates carried thereby and providing open bays, said plates being spaced a vertical distance corresponding to a horizontal dimension of said bay to permit horizontal flow of water transversely between said plates and to limit movement of water vertically between said plates; said frame means being at a depth below significant wave action for inhibiting heave motion by entrapping water between said plates and for increasing the natural period of the apparatus to an amount greater than the peak period of the wave spectrum;

a keel assembly at the lower end of the frame mean including ballast means and buoyancy compartments;

and anchor means connected to said apparatus at a depth of water where horizontal movement of the frame means is minimal.

2. An apparatus as claimed in claim 1 wherein said spaced plates define a plurality of bays of substantially equal volume.

3. An apparatus as claimed in claim 1 wherein each plate is of substantially the same area.

4. An apparatus as claimed in claim 1 wherein each plate includes the same aspect ratio.

5. An apparatus as claimed in claim 1 including means for increasing the area of selected plates.

6. An apparatus as claimed in claim 5 wherein said selected plate is adjacent said keel means.

7. An apparatus as claimed in claim 1 wherein said ballast means in said keel assembly includes ballast to provide static stability to said apparatus when in place.

8. An apparatus as claimed in claim 7 including means for dumping said ballast.

9. An apparatus as claimed in claim 1 wherein said anchor means includes a taut anchor system having mooring lines arranged at 90 degrees to said frame means.

10. An apparatus as claimed in claim 9 wherein said mooring lines at each 90 degree installation include a plurality of lines.

11. In an offshore apparatus for use over one or more seafloor wellheads for drilling and/or producing an oil field, the combination of;

a hull means adapted to be partially submerged in the sea and having a bottom end portion at a depth where wave energy is attenuated;

means for achieving a selected natural period for said apparatus depending upon the expected wave conditions at the locality of the oil field comprising:

a downwardly extending frame means connected to said bottom end portion and extending into a depth beyond significant wave action, said frame means having a plurality of vertically spaced horizontal plates defining bays having windows open for relative transverse movement of water through said bays and for entrapment of water in said bays upon relative vertical motion of said frame means and water;

a keel assembly having ballast means of selected weight;

and anchor means connected to said apparatus.

12. An apparatus as claimed in claim 11 including means on said frame means for increasing the area of a selected plate to modify the selected period of the apparatus.

13. An apparatus as claimed in claim 12 wherein said area increasing means includes plate extensions outboardly of said frame means.

14. An apparatus as claimed in claim 13 including means for moving said plate extensions between horizontal and vertical positions.

15. An apparatus for minimizing heave, pitch, and roll motions of buoyant deep draft offshore apparatus comprising:

frame means including a plurality of vertically arranged bays defined by horizontal plates vertically spaced a selected distance related to the aspect ratio of a plate and by open windows between said plates, said windows providing transparency to ocean current in a horizontal direction to minimize drag loads, said plates defining a substantially water impervious barrier to entrap water in said bays in a vertical direction relative to said frame means, thereby increasing the effective mass of the offshore apparatus, and said frame means being connected to said apparatus and extending downwardly therefrom, whereby the natural period of said apparatus is modified to minimize heave, pitch, and roll motions of said apparatus.

16. An apparatus as claimed in claim 15 including:

a keel assembly at the bottom end of the frame means for stabilizing said apparatus.

17. An apparatus as claimed in claim 16 wherein said keel assembly includes:

a ballast compartment for receiving ballast material and having means for discharging said material, and buoyancy compartments for changing the position of said apparatus between vertical and horizontal.

18. An apparatus as claimed in claim 15 including:

an anchor system comprising mooring lines connected to said frame means at a location of minimal cyclic motion, said system including anchor means embedded in the sea floor and comprising an anchor pin attached to one end of a mooring line, and a receptacle for releasably retaining said anchor pin at a selected angle.

19. In a buoyant offshore apparatus for drilling and production of an oil field, said apparatus including a taut anchor system which includes:

anchor means comprising an anchor box for holding ballast, a downwardly projecting peripheral skirt on said box for penetrating the sea floor, said box having side walls, means for holding an anchor member at a selected angle to direct mooring forces through a juxtaposed portion of said skirt, and means for securing said anchor member in said holding means against relative movement therewith.

20. A device for use with an offshore apparatus having a plurality of risers, comprising:

a substantially vertical frame adapted to extend downwardly from the offshore apparatus;

a plurality of substantially horizontal vertically spaced plates associated with the frame, the plates being substantially water impervious and having a plurality of riser openings defined therein; and a plurality of windows between adjacent plates that allow water to flow horizontally between adjacent plates.

21. A device for use with an offshore apparatus as claimed in claim 20, wherein the plurality of substantially horizontal vertically spaced plates comprises a first plate and a second plate and the riser openings defined in the first plate are substantially larger than the riser openings in the second plate.

22. A device for use with an offshore apparatus as claimed in claim 20, wherein at least one of the plurality of substantially horizontal vertically spaced plates comprises an extension plate.

23. A device for use with an offshore apparatus as claimed in claim 20, wherein at least two adjacent plates are spaced from one another by a selected distance corresponding to the aspect ratio of one of the plates.

24. A device for use with an offshore apparatus, comprising:

a substantially vertical frame adapted to extend downwardly from the offshore apparatus; and a plurality of bays vertically spaced along the frame, each bay including substantially water impervious top and bottom portions that substantially prevent water from flowing vertically from one bay to an adjacent bay, and each bay defining a plurality of vertically extending windows that allow water to flow horizontally through each bay.

25. A device for use with an offshore apparatus as claimed in claim 24, wherein the top and bottom portions of one of the bays are spaced from one another by a selected distance corresponding to the aspect ratio of one of the portions.

26. A device for use with an offshore apparatus as claimed in claim 24, wherein at least one of the top and bottom portions comprises an extension plate.

27. An offshore apparatus, comprising:

a hull adapted to be partially submerged in the sea and having a bottom end portion at a depth where wave energy is attenuated; and control means for achieving a selected natural period for the offshore apparatus corresponding to expected wave conditions, the control means including, a downwardly extending frame associated with the bottom end portion of the hull and extending to a depth beyond significant wave action, and a plurality of vertically spaced substantially horizontal plates associated with the frame and defining bays which trap water therein upon relative vertical motion of the frame and water, the bays having windows that allow transverse movement of water through the bays.

28. A device for use with an offshore apparatus as claimed in claim 27, wherein at least two adjacent plates are spaced from one another by a selected distance corresponding to the aspect ratio of one of the plates.

29. A device for use with an offshore apparatus, comprising:

a substantially vertical frame adapted to extend downwardly from the offshore apparatus; and at least one bay associated with the substantially vertical frame, the at least one bay including substantially water impervious top and bottom portions that substantially prevent water within the bay from flowing vertically, the at least one bay defining a plurality of vertically extending windows that allow water to flow horizontally through the bay.

30. A device for use with an offshore apparatus as claimed in claim 29, wherein the top and bottom portions of the at least one bay are spaced from one another by a selected distance corresponding to the aspect ratio of one of the portions.

* * * * *